US011034013B2

(12) United States Patent
Mulligan

(10) Patent No.: US 11,034,013 B2
(45) Date of Patent: Jun. 15, 2021

(54) OPEN END WRENCH ATTACHMENT DEVICE

(71) Applicant: Gerald Shane Mulligan, Boise, ID (US)

(72) Inventor: Gerald Shane Mulligan, Boise, ID (US)

( * ) Notice: Subject to any disclaimer, the term of this patent is extended or adjusted under 35 U.S.C. 154(b) by 337 days.

(21) Appl. No.: 15/810,816

(22) Filed: Nov. 13, 2017

(65) Prior Publication Data

US 2018/0065241 A1 Mar. 8, 2018

Related U.S. Application Data

(63) Continuation-in-part of application No. 15/197,422, filed on Jun. 29, 2016, now abandoned, and a continuation-in-part of application No. 13/999,059, filed on Mar. 4, 2014, now abandoned.

(51) Int. Cl.

| | |
|---|---|
| ***B25G 1/04*** | (2006.01) |
| ***B25B 13/08*** | (2006.01) |
| ***B25G 1/00*** | (2006.01) |
| ***B25G 1/10*** | (2006.01) |
| ***B25B 13/04*** | (2006.01) |

(52) U.S. Cl.

CPC ..... *B25G 1/043* (2013.01); *B25B 13/04* (2013.01); *B25B 13/08* (2013.01); *B25G 1/005* (2013.01); *B25G 1/102* (2013.01); *B25G 1/105* (2013.01)

(58) Field of Classification Search

CPC ..... B25G 1/043; B25G 1/005; B25G 1/102; B25G 1/105; B25G 3/24; B25B 13/04; B25B 13/08; B25B 23/0021; B25B 13/481; B25B 13/06; B25B 23/16; B25F 1/00; Y10T 16/473

USPC ..... 81/177.2; 7/166, 167

See application file for complete search history.

(56) References Cited

U.S. PATENT DOCUMENTS

| | | | | | |
|---|---|---|---|---|---|
| 1,511,738 | A * | 10/1924 | Lownsbery | B25G 1/043 | 81/177.2 |
| 1,643,027 | A * | 9/1927 | Morgan | B25G 1/025 | 81/177.2 |
| 1,689,639 | A * | 10/1928 | Neff | B25B 13/08 | 81/177.2 |
| 2,605,665 | A * | 8/1952 | Grenat | B25F 1/00 | 81/124.4 |
| 2,725,773 | A * | 12/1955 | Anacker | B25B 13/481 | 81/177.2 |
| 4,104,935 | A * | 8/1978 | Stoops | B25G 1/043 | 81/177.2 |
| 5,477,758 | A * | 12/1995 | Cunningham | B25B 27/0035 | 81/124.4 |

(Continued)

*Primary Examiner* — Orlando E Aviles
*Assistant Examiner* — Robert F Neibaur
(74) *Attorney, Agent, or Firm* — Scott Swanson; Shaver & Swanson, LLP

(57) ABSTRACT

An only open end wrench attachment device incorporates a pommel to prevent slippage of the user's hands, a griping section with a plurality of grooves, a cylindrical length hilt section between the gripping area and the attachment apex to provide various lengths and an attachment apex that provides both parallel and angle attachment for an open end wrench, thereby providing a tool which is solid with no moving parts and is designed to be easily scaled from 9 inches long to 6 feet in length to accommodate wrenches both metric and standard from ¼ inch to 5 inch.

4 Claims, 5 Drawing Sheets

(56) References Cited

U.S. PATENT DOCUMENTS

| | | | | |
|---|---|---|---|---|
| 5,535,649 | A * | 7/1996 | Waggle, Jr. | B25G 1/005 81/177.2 |
| 6,626,069 | B1 * | 9/2003 | Cooper | B25G 1/043 81/177.2 |
| 8,931,376 | B2 * | 1/2015 | Humphrey | B25G 1/005 81/177.2 |
| 2004/0200325 | A1 * | 10/2004 | Huffman | B25B 23/16 81/177.2 |
| 2005/0183550 | A1 * | 8/2005 | Day | B25G 1/043 81/177.2 |
| 2005/0279193 | A1 * | 12/2005 | Darby | B25G 1/043 81/177.2 |
| 2012/0227550 | A1 * | 9/2012 | Belanger | B25G 1/102 81/177.2 |
| 2015/0258665 | A1 * | 9/2015 | East | B25B 13/065 81/124.4 |

* cited by examiner

OPEN END WRENCH ATTACHMENT DEVICE

FIELD OF THE INVENTION

The present invention relates generally to an open end wrench attachment device. More specifically, the present invention is an attachment device that effectively and safely engages with an open-end wrench to provide additional length at both vertical and angled positions.

BACKGROUND OF THE INVENTION

Currently, there is a lack of quality and effective tools that can provide additional length for an open-end wrench. Although there are several existing extension tools are available within the tool industry, each existing extension tool is not able to fully comply with the open-end wrench. For example, even though most of the existing extension tools are able to engage with the open-end wrench, they are not able to fully lock in place with the open-end wrench. As a result, these existing extension tools tend to slip and disengage when force is applied. Additionally, some existing extension tools lack proper surface area for gripping. As a result, the user is not able to fully utilize those extension tools when required. Furthermore, some existing extension tools require intermediary tool components to adequately engage with the open-end wrench. Use of intermediary tool components create a cumbersome assembly and unnecessary failure points within the cumbersome assembly, creating an unsafe work environment for the user.

It is an objective of the present invention to provide an attachment device that effectively and safely engages with an open-end wrench. The present invention is manufactured in the field of mechanics, aircraft, auto, tractor, and any other related tool industry to provide the full scope of a completed device that can effectively and safely engage with the open-end wrench. More specifically, the apex of the present invention provides a secured engagement between the present invention and the open-end wrench. A hilt of the present invention is able to provide proper grip and leverage in order to effectively rotate the open-end wrench.

DETAIL DESCRIPTIONS OF THE INVENTION

All illustrations of the drawings are for the purpose of describing selected versions of the present invention and are not intended to limit the scope of the present invention.

Figure 1:
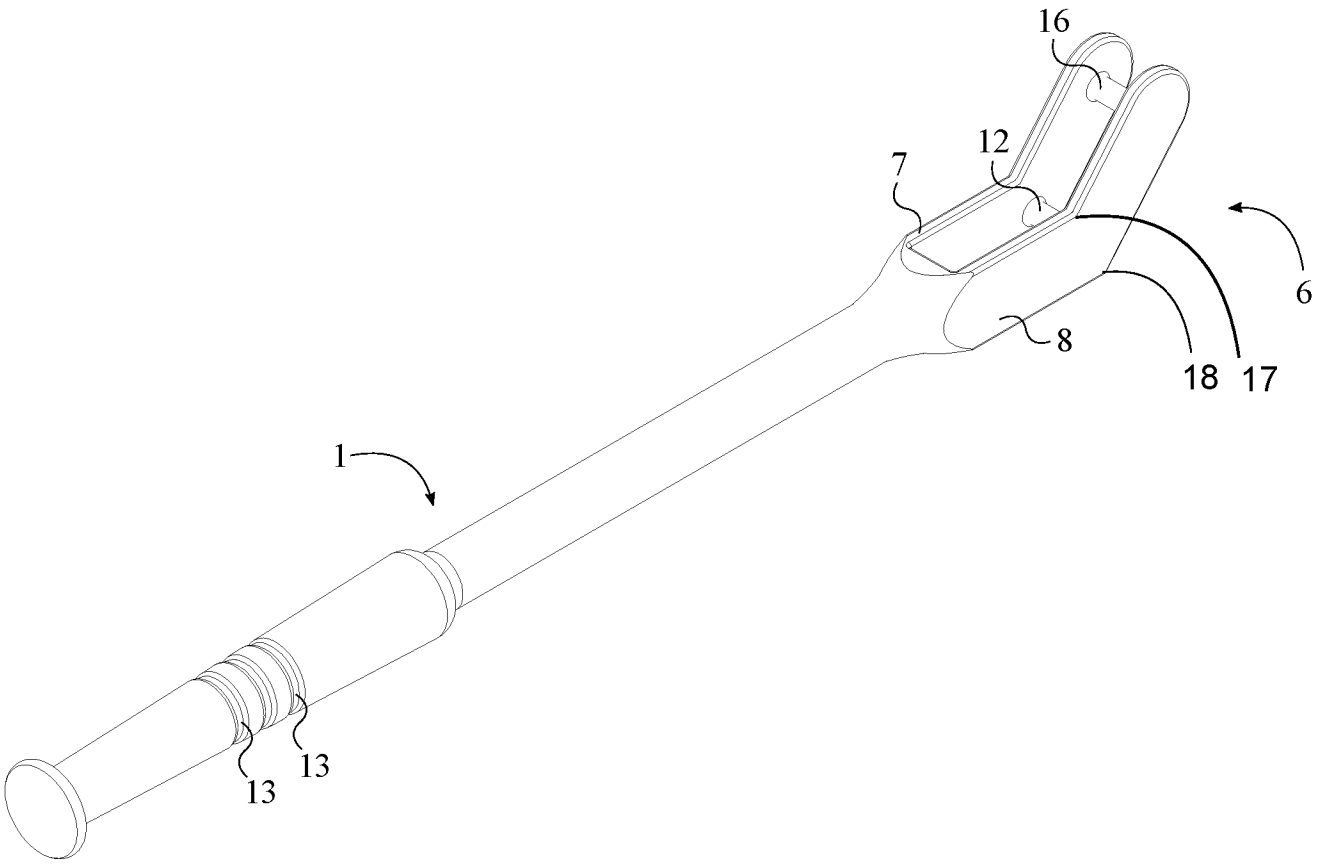
FIG. 1 is a perspective view of the present invention.

The present invention is an attachment device that safely and effectively engages with an open-end wrench to provide additional length at both parallel and angled attachment. The present invention is of solid material construction and does not utilize any moving or removable components. The present invention locks in place with the open-end wrench when forward pressure is applied and releases from the open-end wrench when pressure is reversed. In reference to FIG. 1, the present invention comprises a hilt 1 and a wrench securing apex 6. The hilt 1 is axially connected to the wrench securing apex 6. The wrench securing apex 6 engages and locks in place with the open-end wrench, and the hilt 1 provides the necessary length and the surface area for the user to grasp the present invention. As a result, the user is able effectively apply pressure to the open-end wrench through the wrench securing apex 6 and the hilt 1. Even though the present invention is described in relation to the open-end wrench, it is to be understood that the present invention can also be used in relation to a close end wrench. Additionally, the present invention is also compatible with a full set of metric wrenches and a full set of standard wrenches.

The hilt 1 is an elongated cylindrical member and is completed with multiple sections to provide multiple functionalities within the present invention. Each of those functionality is explained with respect to the specific section of the cylindrical hilt 1 hereafter. In reference to FIG. 2-3, the cylindrical hilt 1 comprises a pommel end 2, a grip section 3, and an extended length section 4. The pommel end 2, the grip section 3, and the extended length section 4 are axially oriented along a central axis 5 of the hilt 1. As a result, the pommel end 2 is adjacently positioned with the grip section 3. The extended length section 4 is adjacently positioned with the grip section 3, opposite of the pommel end 2. Ergonomic shapes of the pommel end 2 and the grip section 3 allow the user to grasp the present invention with the user's hands. More specifically, the user utilizes one hand to secure the pommel end 2 while the other hand is utilized to secure the grip section 3. The grip section 3 provides sufficient griping surface for the user so that the user can fully grasp the cylindrical hilt 1. The pommel 2 also improves the gripping ability of the cylindrical hilt 1 and guards against slip potential of the user's hand off the cylindrical hilt 1. The length of the extended length section 4 may vary from one embodiment to another in order to increase or decrease the cylindrical hilt arm of the present invention. In other words, the extended length section 4 determines different overall lengths of the present invention as the extended length section 4 functions as the connection cylindrical hilt member between the grip section 3 and the open end wrench securing apex 6.

Figure 2:
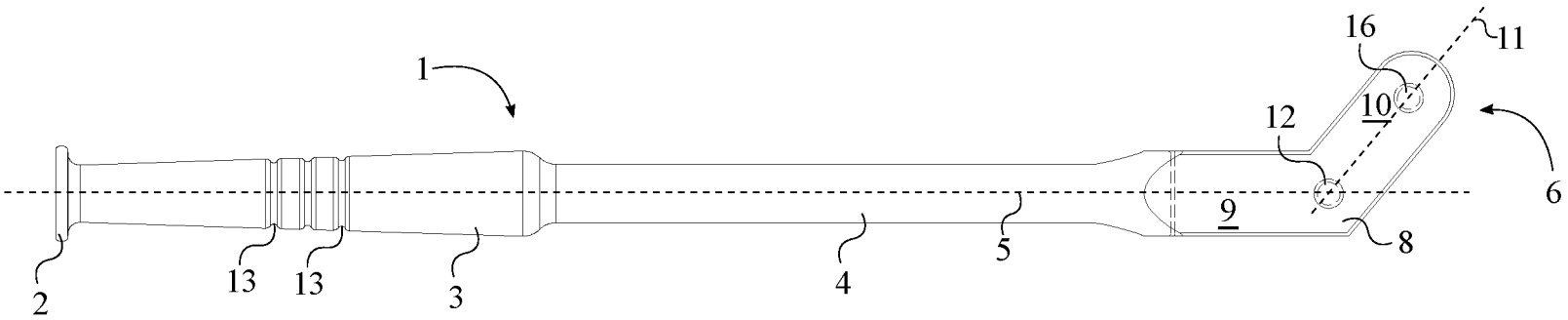
FIG. 2 is a side view of the present invention.

In reference to FIG. 2, the present invention further comprises a plurality of grooves 13 so that the user is able to apply the required amount of force to the present invention without generating slippage. In other words, the plurality of grooves 13 provides optimal grip ability for the present invention as the plurality of grooves 13 is distributed along the grip section 3. As a result, the user is able to create a stable grip around the grip section 3 during the operation of the present invention. More specifically, the plurality of grooves 13 is traversed into the grip section 3 and radially positioned around the grip section 3. In reference to preferred embodiment of the present invention, the plurality of grooves 13 is centrally positioned with the grip section 3. As a result, the plurality of grooves 13 is able to comfortably and ergonomically position within the palm of the user's hand. In reference to an alternative embodiment of the present invention, the plurality of grooves 13 comprises a first set of grooves and a second set of grooves. The first set of grooves is adjacently positioned with the pommel end 2, and the second set of grooves is adjacently positioned with the extended section 4. As a result, the first set of grooves and the second set of grooves are able to collectively retain the user's hand around the grip section 3 minimizing the slippage within the present invention. Even though the plurality of grooves 13 is separated into the first set of grooves and the second set of grooves within the alternative embodiment, the present invention can include any number of grooves within the grip section 3 as long as the plurality of grooves 13 improves friction between the hilt 1 and the user's hand.

Figure 4:
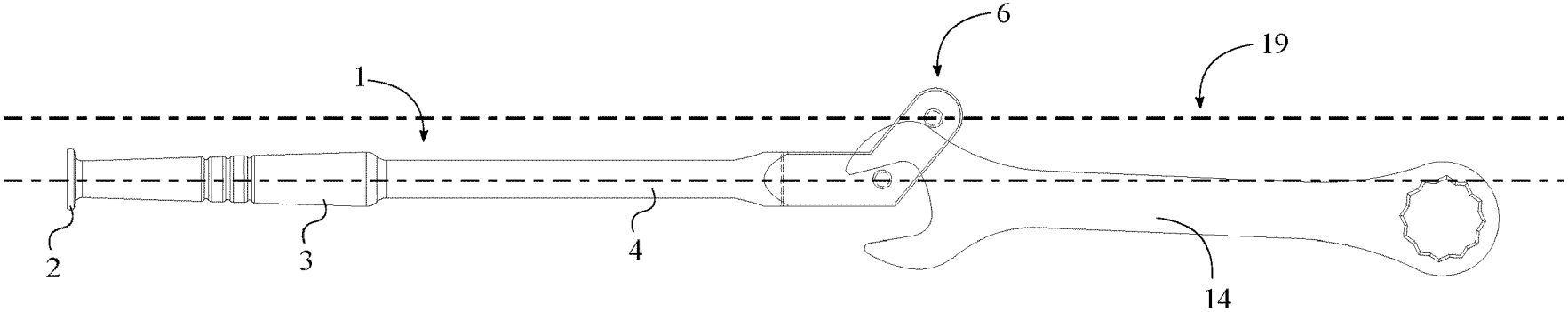
FIG. 4 is a side view of the present invention showing a parallel wrench to invention connection at the zero-degree position angle.
Figure 5:
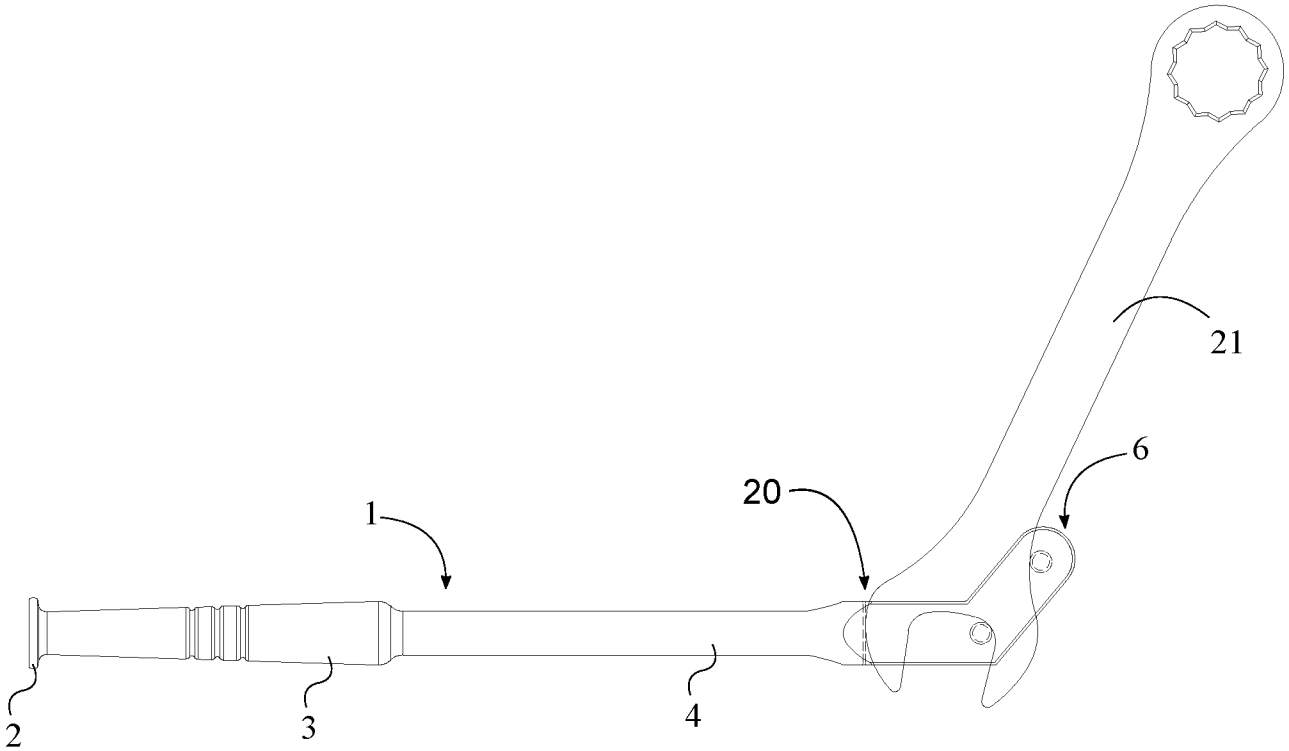
FIG. 5 is a side view of the present invention showing an angled wrench to invention connection at the 0° to 45° angle position.

The wrench securing apex 6 engages and locks with the open-end wrench so that the user is able to apply pressure to the open-end wrench through the present invention. In reference to FIG. 1-3, the wrench securing apex 6 comprises a first lateral side 7, a second lateral side 8, a cylindrical connecting point 12 and a cylindrical positioning point 16. The first lateral side 7 and the second lateral side 8 provide lateral placement for the present invention with respect to the open-end wrench. More specifically, the first lateral side 7 and the second lateral side 8 are connected to the extended section 4, opposite of the grip section 3. Additionally, the first lateral side 7 and the second lateral side 8 are diametrically opposed and oriented parallel to each other. As a result of those configurations of the first lateral side 7 and the second lateral side 8, the wrench securing apex 6 is able to be fully positioned around the open-end wrench. Furthermore, the first lateral side 7 and the second lateral side 8 each comprise a straight section 9 and an angled section 10 as shown in FIG. 2. The straight section 9 of the first lateral side 7 and the straight section 9 of the second lateral side 8 are connected with the extended section 4. The angled section 10 of the first lateral side 7 and the angled section 10 of the second lateral side 8 are respectively connected with the straight section 9 of the first lateral side 7 and the straight section 9 of the second lateral side 8. Collectively, the straight section 9 and the angled section 10 of the first lateral side 7 and the second lateral side 8 are able to fully enclose both jaws of the open-end wrench when the present invention is utilized. Furthermore, the angled section 10 of the first lateral side 7 and the angled section 10 of the second lateral side 8 provide two position angles for the open-end wrench. The two position angles of the present invention are shown in FIG. 4-5 as the two position angles are changed from zero to 45 degree offset with respect to the open-end wrench.

Figure 3:
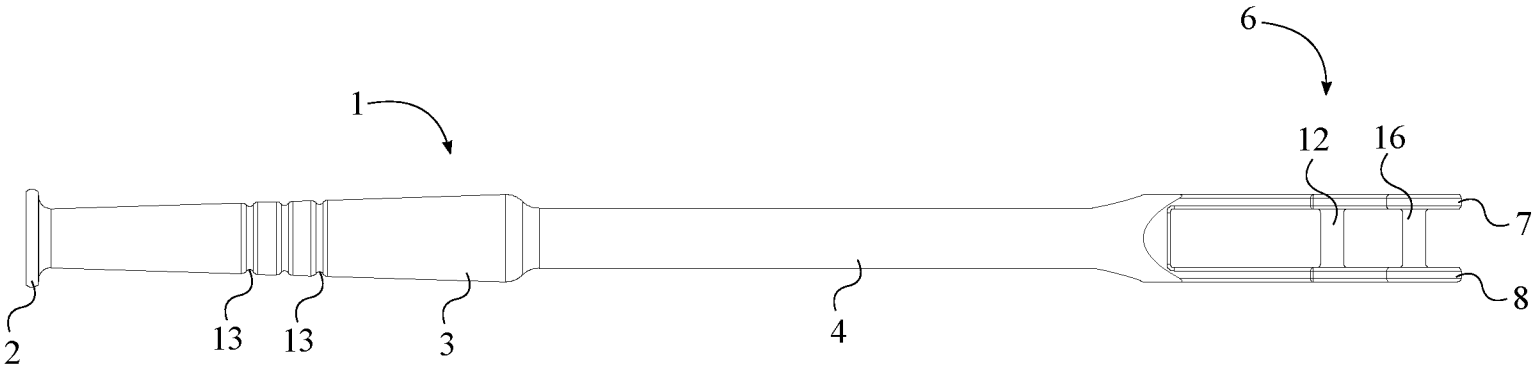
FIG. 3 is a top view of the present invention.

In reference to FIG. 2-3, the pair of locking pins 12 and 16 is connected in between the first lateral side 7 and the second lateral side 8. More specifically, the cylindrical connecting point 12 and the cylindrical positioning point 16 are perpendicularly oriented with the first lateral side 7 and second lateral side 8 and is connected in between the angled section 10 of the first lateral side 7 and the angled section 10 of the second lateral side 8. Additionally, the cylindrical connecting point 12 and the cylindrical positioning point 16 are extended across an angular axis 11 of the wrench securing apex 6, wherein the angular axis 11 positioned parallel to the angled section 10 of the first lateral side 7 and the angled section 10 of the second later side 8. As a result of the cylindrical connecting point 12 and the cylindrical positioning point 16, the present invention can be safely engaged with both jaws of the open-wrench.

Although the invention has been explained in relation to its preferred embodiment, it is to be understood that many other possible modifications and variations can be made without departing from the spirit and scope of the invention as hereinafter claimed.

What is claimed is:

1. A wrench extension tool for enhanced application of force and torsion upon an open end wrench, said tool comprising: a tool body, said tool body comprising a first end and a second end, wherein said first end comprising a wrench securing head; wherein said wrench securing head comprising a first lateral plate and a second lateral plate, said first lateral plate and said second lateral plate being directly attached to said tool body, wherein a space is defined between said first lateral plate and said second lateral plate, said first lateral plate and said second lateral plate being diametrically opposed and parallel and extending in-line with said tool body from said tool body; a first pin and a second pin attaching to said first lateral plate and said second lateral plate and extending between said first lateral plate and said second lateral plate, wherein said first lateral plate and said second lateral plate each comprise a straight section and an angled section, wherein said straight section extends longitudinally from said tool body to said first pin, wherein said angled section extends longitudinally, at an obtuse angle from said straight section, from said first pin to said second pin in; and said first pin and said second pin are spaced apart such that said first pin is configured for attaching the head of an open end wrench and said second pin being configured to apply force and torsion to an open end wrench and said first lateral plate and said second lateral plate are configured for the medial positioning of said open end wrench.

2. The wrench extension tool of claim 1 wherein said second end comprises a handle.

3. The wrench extension tool of claim 1 wherein said first lateral plate and said second lateral plate is integral to said tool body.

4. The wrench extension tool of claim 1 wherein wrench extension tool is configured such that an open end wrench can attach to said first pin from both above and below said first pin.

* * * * *